United States Patent [19]

Karlsson

[11] Patent Number: 4,788,552

[45] Date of Patent: Nov. 29, 1988

[54] WAVE GUIDE ELEMENT FOR AN ELECTRICALLY CONTROLLED RADAR ANTENNA

[75] Inventor: Erik R. Karlsson, Göteborg, Sweden

[73] Assignee: Telefonaktiebolaget L M Ericsson, Stockholm, Sweden

[21] Appl. No.: 925,177

[22] Filed: Oct. 31, 1986

[30] Foreign Application Priority Data

Oct. 31, 1985 [SE] Sweden ..... 85051522

[51] Int. Cl.[4] ..... H01Q 13/18

[52] U.S. Cl. ..... 343/771; 343/767; 343/777

[58] Field of Search ..... 343/767, 770, 771, 777

[56] References Cited

U.S. PATENT DOCUMENTS

| | | | |
|---|---|---|---|
| 3,193,830 | 7/1965 | Provencher | 343/771 |
| 3,363,253 | 1/1968 | Ratkevich | 343/771 |
| 3,524,189 | 8/1970 | Jones, Jr. | 343/771 |
| 4,079,361 | 3/1978 | Woode | 343/771 |
| 4,423,421 | 12/1983 | Peeler et al. | 343/771 |

FOREIGN PATENT DOCUMENTS

| | | | |
|---|---|---|---|
| 1220382 | 1/1971 | Canada | 343/705 |
| 0126626 | 11/1984 | European Pat. Off. | 343/771 |
| 0159301 | 10/1985 | European Pat. Off. | 343/770 |
| 56-25804 | 12/1981 | Japan . | |

*Primary Examiner*—William L. Sikes
*Assistant Examiner*—Doris J. Johnson
*Attorney, Agent, or Firm*—Burns, Doane, Swecker & Mathis

[57] ABSTRACT

A waveguide element for an electrically controlled radar antenna comprises a non-resonant waveguide (V) fed from a feed opening (M). The feed opening divides the waveguide longitudinally into a first and a second part, each provided at its outer end with absorbent terminations (A1, A2). Slits ($S_{11}$, $S_{12}$, $S_{21}$, $S_{22}$, etc) are formed in the waveguide, and their central points in the longitudinal direction have in the first part a mutual spacing ($d_1$) which is less than half the wavelength ($\lambda g/2$), while their central points in the longitudinal direction in the second half have a mutual spacing ($d_2$) which is greater than half the wavelength.

4 Claims, 2 Drawing Sheets

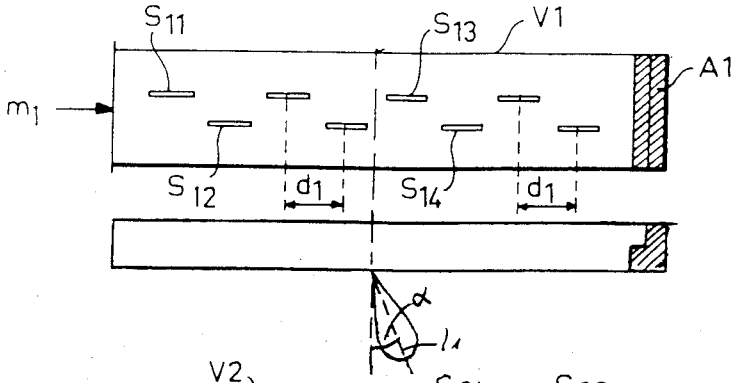
Fig. 1
PRIOR ART
FIG. 1A
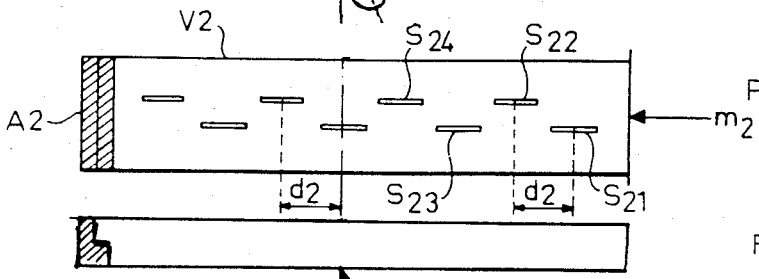
Fig. 2
PRIOR ART
FIG 2A
4,788,552
Fig.3
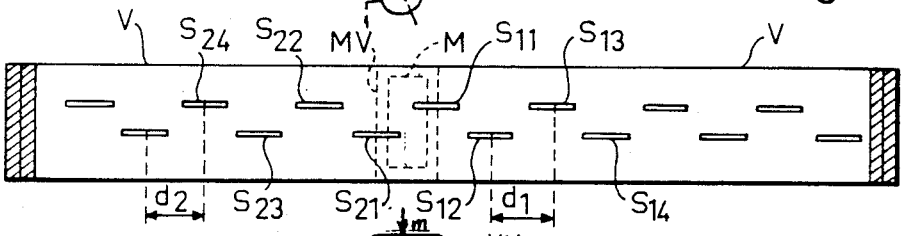
Fig. 4
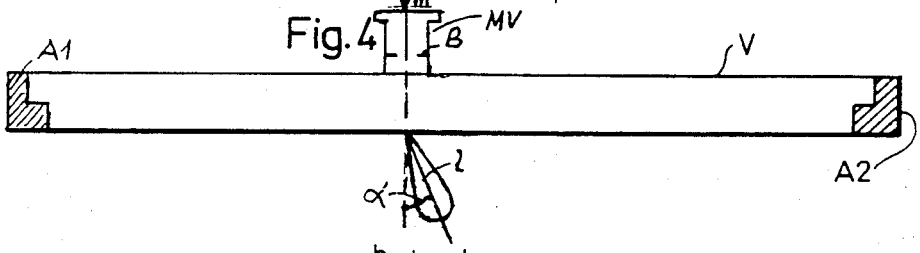
Fig. 8
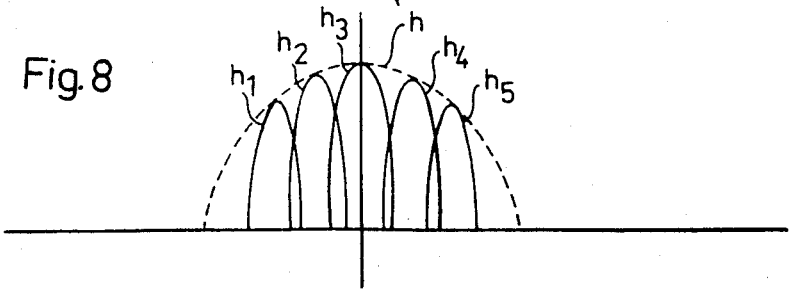

WAVE GUIDE ELEMENT FOR AN ELECTRICALLY CONTROLLED RADAR ANTENNA

TECHNICAL FIELD

The present invention relates to a wave guide element of non-resonant type, provided with radiation openings in the form of slits for use in constructing a wide-band, electrically controlled radar antenna including a plurality of such elements, a so-called antenna array.

BACKGROUND

An antenna array usually comprises a plurality of antenna elements situated side by side with a common distribution network connecting the individual elements to a feed point through which the electromagnetic field is fed at a given microwave frequency, e.g. within the X band. The antenna elements may comprise centrally fed waveguides provided with radiation openings in the form of slits along the side surface opposite the feed opening. the U.S. Pat. Nos. 3,363,253 and 4,429,313 illustrate examples of such an antenna in a resonant implementation, i.e. where a slitted wave guide is short-circuited at its ends, and where the slits are placed exactly half a wavelength ($\lambda g/2$) from each other, thus obtaining a standing wave. An antenna array of this kind generally has the advantage that it may be controlled electrically, i.e. the direction of the main lobe of the antenna may be varied by varying the phase of the electromagnetic field fed to the individual antenna elements. A disadvantage with a resonant-type antenna is its very restricted bandwidth properties.

Another type of wave guide antenna element is a non-resonant element provided with an absorbent termination, and where the slits have mutual spacing differing somewhat from half the wavelength ($\lambda g/2$), a propagating wave thus being obtained. C.f. R. C. Hansen, "Microwave Scanning Antennas", Part III. In this type of element the lobe is directed at a given angle to the normal. On a change of the frequency of the energy fed to the element via the feed opening the lobe moves in relation to the normal of the element, however, i.e. the lobe direction varies with the frequency, making the antenna array unusable in many applications, unless special measures are taken.

DISCLOSURE OF INVENTION

The object of this invention is to achieve an antenna element provided with slits such as to combine the good properties of both the types mentioned above, i.e. no variation in lobe direction for variations in frequency, and a large frequency range, without their drawbacks, i.e. small frequency range and alteration of the lobe direction.

This is achieved in accordance with the invention by combining two nonresonant wave guide elements as disclosed in the characterizing part of claim 1.

BRIEF DESCRIPTION OF DRAWINGS

The invention will now be described in detail with reference to the accompanying drawings, where FIGS. 1 and 1*a* as well as FIGS. 2 and 2*a* are front views and plans, respectively, of non-resonant antenna elements of a kind known per se, FIGS. 3 and 4 are a front view and plan of an antenna element in accordance with the invention, FIG. 8 is a lobe diagram pertaining to the antenna array, in the case where the lobe is controlled in height.

BEST MODES FOR CARRYING OUT THE INVENTION

Figure 5:
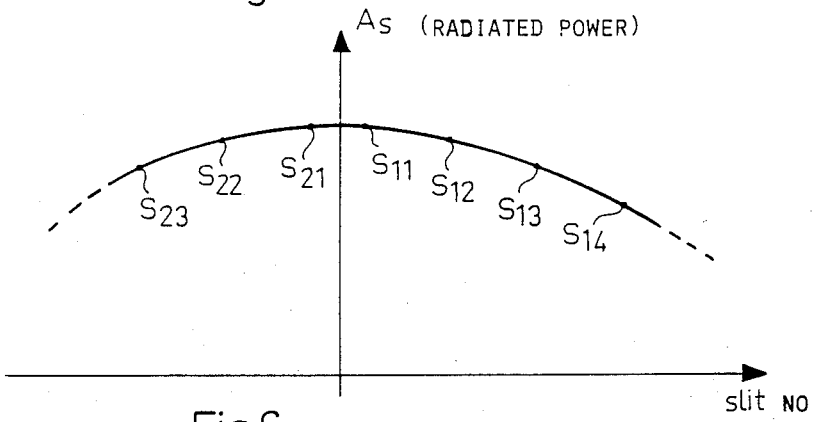
FIG. 5 is a diagram of the radiated antenna power distribution along the antenna element in FIGS. 3 and 4.

FIGS. 1 and 1*a* as well as FIGS. 2 and 2*a* illustrate the two parts, known per se, included in an inventive antenna element. The element in FIG. 1 comprises a suitably rectangular waveguide V1, provided along its wider longitudinal side with radiation openings in the form of a plurality of slits $S_{11}$–$S_{14}$ in a known manner. The arrow m, indicates the waveguide opening into which electromagnetic energy at a given frequency is fed. At its side opposite to the opening, the waveguide is provided with a termination A of absorbent material. When the waveguide is fed with electromagnetic energy, the former constitutes an antenna element and sends out through the slits a field, the lobe diagram of which is indicated schematically in FIG. 1*a*. Only the main lobe $l_1$ is illustrated, while the side lobes have been excluded. For a given frequency of the fed-in energy there is obtained a direction of the main lobe defined by the angle $\alpha$ in relation to a normal to the antenna element. The distance $d_1$ between the central point of two adjacent aslits $S_{11}$, $S_{12}$ or the pitch of the slits in a waveguide of the type mentioned is selected such that the phase difference longitudinally along the guide will be near zero. This phase difference determines what angle $\alpha$ is obtained. Small phase differences give small angles $\alpha$, which is desirable. The angle $\alpha$ varies for an increase or decrease in the frequency, and the lobe $l_1$ is turned to, or away from the normal of the antenna element.

FIG. 2 illustrates the same kind of terminated antenna element as in FIG. 1, but with a feed direction $m_2$ from the right in the figure. For a change in frequency the lobe $l_2$ will change direction in the opposite direction in relation to the change in the lobe $\mathbf{1}_1$, i.e. for an increase in frequency $\mathbf{1}_1$ will be turned to the left and $l_2$ to the right, and vice versa.

In accordance with the invention, the two antenna elements in FIGS. 1 and 2*a* are combined into a single antenna element with a common feed opening such as simultaneously to achieve the advantages with a resonant and non-resonant antenna element. FIG. 3 illustrates such an element in a front view, while FIG. 4 illustrates it in plan. It will be seen that a feed waveguide MV is connected to the waveguide V, and according to the embodiment the center line of the feed waveguide MV coincides with that of the antenna waveguide. The feed direction is indicated by the arrow m, and via an aperture B the fed-in energy will distribute itself equally in the right and left parts of the waveguide V. Using appropriate measures it is, however, possible to distribute the feed power differently to the left or right part of the feed opening of the waveguide V, as well as to place the waveguide MV at some location other than at the center line of the waveguide V. Feed to the antenna element may also take place otherwise than by a feed waveguide, e.g. using the coaxial technique so-called "probe". Both terminations A1 and A2 are carried out conventionally such as to absorb the power remaining at the respective end part of the waveguide V.

As will be seen from FIG. 3, the waveguide V is provided along its wide longitudinal side with radiation openings $S_{11}$, $S_{12}$, $S_{13}$, $S_{14}$, . . . $S_{21}$, $S_{22}$, $S_{23}$, $S_{24}$ in the same way as the elements V1, V2 in FIGS. 1 and 2, these openings being arranged on either side of the center line of the waveguide in its longitudinal direction. The distance between the centers of two adjacent slits is denoted by $d_1$ for those to the right, and $d_2$ for those to the left of the feed opening M, $d_1 \neq d_2$. The distances $d_1$ and $d_2$ are determined by the wavelength $\lambda_g$ of the energy fed to the waveguide, and by the condition that the direction $\alpha$ of the partial lobes from each part of the antenna element shall be equal. For example, if an angle $\alpha=5°$, a center frequency of 9 GHz and a waveguide dimension (such as 10×25 mm) suitable for the frequency are selected, $\lambda_g$ is determined by the dimensions and the center frequency and $d_1$ by $\lambda_g$ and $\alpha$. As will be seen from FIG. 1 $d_1 > \lambda g/2$ (the lobe points to the right). All the slit distances $d_1$ on this waveguide half will be equal to $d_1$. The distance $d_2$ is determined in a corresponding manner, but $d_2 < \lambda g/2$ (the lobe points to the right in this case as well) and all distances $d_2$ will be mutually equal.

When the slits are spaced $\lambda g/2$ from each other, a phase difference of 180° is obtained between adjacent slits. When two adjacent slits being spaced at $\lambda g/2$ are placed on either side of the center line, a phase difference of 360° is obtained, which may also be regarded as 0°. A phase difference is obtained if two adjacent slits are spaced at a distance different from $\lambda g/2$. The slit spacing thus decides what phase relationships are obtained.

If the phase is 0° longitudinally in the field at the feed point, the phase at the slit $S_{11}$ will be $-\beta$ and at the slit $S_{21}+\beta$ or the reverse. At the slit $S_{12}$ the phase is $360°-2\beta$ and at the slit $S_{22}$ the phase is $360°+2\beta$. At the slit $S_{13}$ the phase is $2\times360°-3\beta$ etc. This is due to the distance $d_1$ being less than and the distance $d_2$ greater than $\lambda g/2$.

FIG. 5 is a diagram of an advantageous distribution of the radiated power longitudinally along the antenna element. It will be seen from the diagram that the power successively diminishes towards the end parts, where it is absorbed by the end terminations A1 and A2.

This advantageous distribution is achieved in a resonant antenna by the slits in the central part of the waveguide having the greatest distance from the longitudinal line of symmetry of the waveguide, and this distance decreases successively towards the ends of the waveguide to feed out the greatest possible power about the central part of the antenna. This distribution is achieved in the inventive antenna without needing to vary the distance from the longitudinal line of symmetry of the waveguide. The explanation is that it is a question of a propagating wave which is tapped of power, and not a standing wave.

Figure 6:
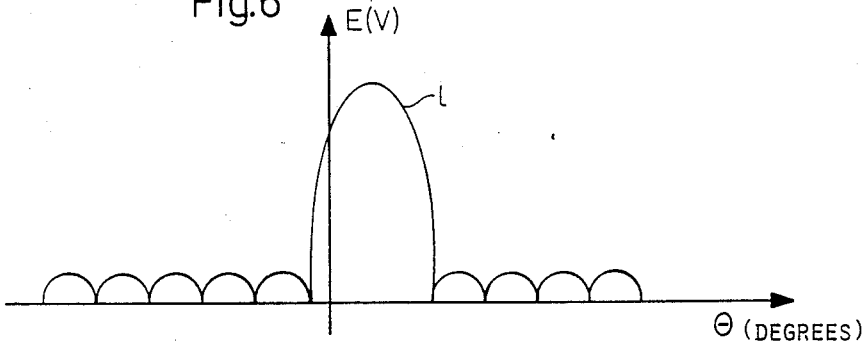
FIG. 6 is the antenna element lobe diagram, FIG. 7 schematically illustrates an antenna array with elements according to FIGS. 3 and 4.

FIG. 6 is the lobe diagram for an antenna element V. Both lobes $l_1$ and $l_2$ from elements $V_1$ and $V_2$ in FIGS. 1 and 2 have formed a main lobe 1 in the combination into a single element according to FIG. 3.

The element feed opening may be placed such that its center line coincides with that of the waveguide V, the number of slits $S_{11}$, $S_{12}$ etc on either side of the feed opening being different. If the number of pairs of slits or slits on each side of the feed opening is the same, the center line of the feed opening will not coincide with the geometrical center line of the element.

Figure 7:
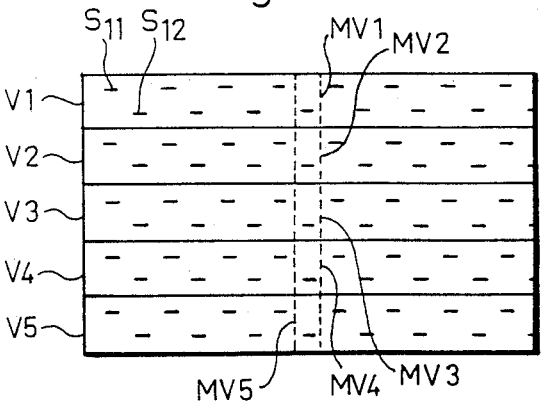

FIG. 7 is a front view of an antenna array, built up from the antenna elements of FIG. 3, five of these elements being placed narrow long side against narrow long side. The feed openings $M_1$, $M_2$, $M_3$, $M_4$, $M_5$ may either be individual for each element, or may constitute openings in a common waveguide fastened to the rear of the joined-together elements, e.g. as illustrated in the above-mentioned U.S. Pat. No. 3,363,253.

In the case where the feed openings are formed by individual feed waveguides MV1–MV5, electrical control of the resulting antenna lobe may be accomplished in the transverse direction of the waveguides in a conventional way by connecting phase-shifting microwave components to each feed waveguide. The phase of the microwave signals fed to the antenna element V1 via waveguide M1 may be the reference phase (0°), for example, The field to the element V2 is then phase shifted an angle of 45° by a phase shifter connected to the feed waveguide M2, the field to the element V3 is phase shifted in the same way by an angle of 90° relative the reference phase, etc.

FIG. 8 is the schematic radiation diagram for the breadth of the antenna array according to FIG. 7. When they are fed with signals having a given phase relationship according to the above, the individual antenna elements V1–V5 give rise to a lobe, e.g. the lobe $h_1$. If the phase relationship is changed, the lobes $h_2$–$h_5$, or some other optional lobe direction, can be achieved. With the aid of the proposed antenna element an electrically controlled antenna may thus be obtained, which gives a main lobe which does not change with the frequency within the band used, e.g. 500 MHz for X band signals and has good side lobe suppression.

I claim:

1. Waveguide antenna element of non-resonant type, provided with radiation openings in the form of slits, for use in constructing a wide-band, electrically controlled radar antenna having a lobe direction independent of a frequency of a fed-in electromagnetic field, the waveguide antenna element (V) including a feed opening (M) for the fed-in electromagnetic field, the feed opening dividing the waveguide antenna element in a longitudinal direction into a first part and a second part, the first and second parts being provided with absorbent terminations (A1, A2) at their outer ends, and a plurality of slits, the slits being arranged on a wide longitudinal side of the waveguide antenna element with their longitudinal directions substantially parallel to the longitudinal direction of the waveguide antenna element, the slits in the first part of the waveguide having centers separated by a first spacing ($d_1$), the first spacing being less than half a wavelength of the fed in field in the waveguide antenna element, and the slits in the second part of the waveguide having centers separated by a second spacing ($d_2$), the second spacing being greater than half the wavelength of the fed-in field, said first and second spacings being selected such that the lobe direction is substantially identical for the first and second parts.

2. Antenna element as claimed in claim 1, characterized in that a first number of slits ($S_{11}$, $S_{12}$, . . . ) of the first part differs from a second number of slits ($S_{21}$, $S_{22}$, . . . ) of the second part, a center line of the feed opening (M) substantially coinciding with a center line of the waveguide antenna element.

3. Antenna element as claimed in claim 1, characterized in that a feed waveguide (MV) is arranged for feeding the electromagnetic field to the common feed opening (M).

4. Antenna element as claimed in claim 2, characterized in that a feed waveguide is arranged for feeding the electromagnetic field to the common feed opening.

* * * * *